US009440242B2

(12) United States Patent
Counter et al.

(10) Patent No.: US 9,440,242 B2
(45) Date of Patent: Sep. 13, 2016

(54) FROTHERS FOR MINERAL FLOTATION

(71) Applicant: Ecolab USA Inc., Naperville, IL (US)

(72) Inventors: James Adrian Counter, New South Wales (AU); John D. Kildea, Baldivis (AU)

(73) Assignee: Ecolab USA Inc., Naperville, IL (US)

( * ) Notice: Subject to any disclaimer, the term of this patent is extended or adjusted under 35 U.S.C. 154(b) by 189 days.

(21) Appl. No.: 14/042,974

(22) Filed: Oct. 1, 2013

(65) Prior Publication Data

US 2015/0090919 A1 Apr. 2, 2015

(51) Int. Cl.

| | |
|---|---|
| ***B03D 1/02*** | (2006.01) |
| ***B03D 1/008*** | (2006.01) |
| ***B03D 1/016*** | (2006.01) |
| ***B03D 1/018*** | (2006.01) |
| ***B03D 1/004*** | (2006.01) |
| *B03D 1/002* | (2006.01) |
| *B03D 1/014* | (2006.01) |

(52) U.S. Cl.

CPC ..... *B03D 1/008* (2013.01); *B03D 1/0043* (2013.01); *B03D 1/02* (2013.01); *B03D 1/002* (2013.01); *B03D 1/014* (2013.01); *B03D 1/016* (2013.01); *B03D 2201/04* (2013.01); *B03D 2203/08* (2013.01)

(58) Field of Classification Search

None

See application file for complete search history.

(56) References Cited

U.S. PATENT DOCUMENTS

| | | | | |
|---|---|---|---|---|
| 4,222,861 | A | 9/1980 | Finch | |
| 4,526,696 | A * | 7/1985 | Delourme | B03D 1/00 209/166 |
| 4,756,823 | A | 7/1988 | O'Neill et al. | |
| 4,915,825 | A | 4/1990 | Christie et al. | |
| 4,929,343 | A | 5/1990 | Wang et al. | |
| 5,304,317 | A | 4/1994 | Barwise et al. | |
| 5,379,902 | A | 1/1995 | Wen et al. | |
| 6,827,220 | B1 | 12/2004 | Young et al. | |
| 7,553,984 | B2 | 6/2009 | Rau et al. | |
| 8,093,303 | B2 | 1/2012 | Hovland et al. | |
| 8,123,042 | B2 | 2/2012 | Tran | |
| 2009/0194466 | A1 | 8/2009 | Hines et al. | |
| 2010/0181520 | A1 | 7/2010 | Gupta et al. | |
| 2010/0213105 | A1 | 8/2010 | De Oliveira Filho et al. | |
| 2011/0020198 | A1 | 1/2011 | Canady et al. | |
| 2011/0198296 | A1 | 8/2011 | Child | |

OTHER PUBLICATIONS

Ahmed et al., "Upgrading difficult-to-float coal using microemulsion", Minerals & Metallurgical Processing, May 2012, vol. 29, No. 2, pp. 88-96.

Han, C.L. et al. "Application research on emulsive collector for coal flotation", Xuanmei Jishu, vol. 3 pp. 4-6 (2005).

Zhu, S.Q. "Evaluation of new emulsified flotation reagent for coal", Science Press Beijing, vol. 2, pp. 1943-1950 (2008).

Saleh, A.M. "Effect of collector emulsification on coal flotation kinetics and on recovery of different particle sizes" Mineral Processing on the verge of the 21st Century, Proceedings of the International Mineral Processing Symposium, 3th Antalya, Turkey, Oct. 1-18, 2000, pp. 391-396 (2000).

Xie, W.W. "Application of novel emulsified flotation regent in coal slime flotation", Xuanmei Jishu vol. 2 pp. 13-15 (2007).

Yu, Q. et al. "A study of surfactant/oil emulsions for fine coal flotation", Advance in Fine Particle Processing, Proc. Int. Symp. pp. 345-355 (1990).

* cited by examiner

*Primary Examiner* — Thomas M Lithgow

(74) *Attorney, Agent, or Firm* — Dorsey & Whitney LLP

(57) ABSTRACT

The invention provides methods and compositions for improving a froth flotation type separation. The method uses a microemulsion to improve the effectiveness of a frother. The improvement allows for low dosages of frother to work as well as much greater amounts of non-microemulsified frother.

15 Claims, No Drawings

FROTHERS FOR MINERAL FLOTATION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to novel methods, compositions, and apparatuses for improving the effectiveness of froth, flotation beneficiation processes. In a beneficiation process, two or more materials which coexist in a mixture (the fines) are separated from each other using chemical and/or mechanical processes. Often one of the materials (the beneficiary) is more valuable or desired than the other material (the gangue).

As described for example in U.S. Pat. Nos. 4,756,823, 5,304,317, 5,379,902, 7,553,984, 6,827,220, 8,093,303, 8,123,042, and in Published US Patent Applications 2010/0181520 A1 and 2011/0198296, and U.S. patent application Ser. No. 13/687,042, one form of beneficiation is froth flotation separation. Commonly, flotation uses the difference in the hydrophobicity of the respective components. The components are introduced into the flotation apparatus sparged with air, to form bubbles. The hydrophobic particles preferentially attach to the bubbles, buoying them to the top of the apparatus. The floated particles (the concentrate) are collected, dewatered and accumulated as a sellable product. The less hydrophobic particles (the tailings) tend to migrate to the bottom of the apparatus from where they can be removed.

Two common forms of flotation separation processes are direct flotation and reverse flotation, in direct flotation processes, the concentrate is the beneficiary and the tailings are the gangue. In reverse flotation processes, the gangue constituent is floated into the concentrate and the beneficiary remains behind in the slurry. The object of flotation is to separate and recover as much of the valuable constituent(s) of the fine as possible in as high a concentration as possible which is then made available for further downstream processing steps.

Froth flotation separation can be used to separate solids from solids (such as the constituents of mine ore) or liquids from solids or from ether liquids (such as the separation of bitumen from oil sands). When used on solids, froth separation also often includes having the solids comminuted (wound up by such techniques as dry-grinding, wet-grinding, and the like). After the solids have been comminuted they are more readily dispersed in the slurry and the small solid hydrophobic particles can more readily adhere to the sparge bubbles.

There are a number of additives that can be added to increase the efficiency of a froth flotation separation. Collectors are additives which adhere to the surface of concentrate particles and enhance their overall hydrophobicity. Gas bubbles then preferentially adhere to the hydrophobized concentrate and it is more readily removed from the slurry than are other constituents, which are less hydrophobic or are hydrophilic. As a result, the collector efficiently pulls particular constituents out of the slurry while the remaining tailings which are not modified by the collector, remain in the slurry. Examples of collectors include oily products such as fuel oil, tar oil, animal oil, vegetable oil, fatty acids, fatty amines, and hydrophobic polymers. Other additives include frothing agents, promoters, regulators, modifiers, depressors (deactivators) and/or activators, which enhance the selectivity of the flotation step and facilitate the removal of the concentrate from the slurry.

The performance of collectors can be enhanced by the use of modifiers. Modifiers may either increase the adsorption of collector onto a given mineral (promoters), or prevent collector from adsorbing onto a mineral (depressants). Promoters are a wide variety of chemicals which in one or more ways enhance the effectiveness of collectors. One way promoters work is by enhancing the dispersion of the collector within the slurry. Another way is by increasing the adhesive force between the concentrate and the bubbles. A third way is by increasing the selectivity of what adheres to the bubbles. This can be achieved by increasing the hydrophilic properties of materials selected to remain within the slurry, these are commonly referred to as depressants.

Frothing agents or frothers are chemicals added to the process which have the ability to change the surface tension of a liquid such that the properties of the sparging bubbles are modified. Frothers may act to stabilize air bubbles so that they will remain well-dispersed in slurry, and will form a stable froth layer that can be removed before the bubbles burst. Ideally the frother should not enhance the flotation of unwanted material and the froth should have the tendency to break down when removed from the flotation apparatus. Collectors are typically added before frothers and they both need to be such that they do not chemically interfere with each other. Commonly used frothers include pine oil, aliphatic alcohols such as MIBC (methyl isobutyl carbinol), polyglycols, polygloycol ethers, polypropylene glycol ethers, polyoxyparafins, cresylic acid (Xylenol), commercially available alcohol blends such as those produced from the production of 2-ethylhexanol and any combination thereof.

The froth must be strong enough to support the weight of the mineral floated and yet not be tenacious and non-flowing. The effectiveness of a frother is dependent also on the nature of the fluid in which the flotation process is conducted. Unfortunately contradictory principles of chemistry are at work in froth flotation separation which forces difficulties on such interactions. Because froth flotation separation relies on separation between more hydrophobic and more hydrophilic particles, the slurry medium often includes water. Because however many commonly used frothers are themselves sparingly soluble in water if at they do not disperse well in water which makes their interactions with the bubbles less than optimal.

Thus it is clear that there is definite utility in improved methods, compositions, and apparatuses for applying frothers in froth separation slurry. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed to a method of enhancing the performance of frothing agent in a froth flotation separation of slurry in a medium. The method comprises the steps of: making stable microemulsion with a frothing agent, a surfactant (optionally also with a cosurfactant) and water, and blending this microemulsion with the medium, tines, and other additives, and removing concentrate from the slurry by sparging the slurry.

The microemulsion may improve the efficiency of froth separation process. More concentrate may be removed than if a greater amount of frother had been used in a non-microemulsion form. The microemulsion may comprise a continuous phase which is water and a dispersed phase. The microemulsion as a whole by weight may be made up of: 1-99% water, blended with: 1-50% of a frother component such as an alcohol blend which is from the waste stream of the production of 2-ethyl hexanol, 1-15% C8-C10 fatty acids, 1-30% 2-butoxy ethanol surfactant, 1-20% propylene glycol, and 1-10% potassium hydroxide.

The microemulsion as a whole by weight may be made up of: 1-99% water, blended with: 1-50% of a frother component such as an alcohol blend which is from the waste stream of the production of 2-ethyl hexanol, 1-20% C8-C10 fatty, acids, 1-30% 2-butoxy ethanol surfactant, and 1-10% potassium hydroxide.

The microemulsion as a whole by weight may be made up of: 1-99% water, blended with: 1-50% of a frother component such as an alcohol blend which is from the waste stream of the production of 2-ethyl hexanol, 1-20% C8-C10 fatty acids, 1-30% propylene glycol, and 1-10% potassium hydroxide.

The microemulsion as a whole by weight may be made up of: 1-99% water, 1-50% of a frother component such as an alcohol blend which is from the waste stream of the production of 2-ethyl hexanol, 1-30% 2-ethyl hexanoic acid, 1-20% 2-butoxy ethanol surfactant, and 1-10% potassium hydroxide.

The slurry may comprise an ore containing one item selected from the list consisting of: copper, gold, silver, iron, lead, nickel, cobalt, platinum, zinc, coal, barite, calamine, fledspar, fluorite, heavy metal oxides, tale, potash, phosphate, iron, graphite, kaolin clay, bauxite, pyrite, mica, quartz, sulfide ore, complex sulfide ore, non-sulfide ore, and any combination thereof.

The frother may be one that would not remain in a stable emulsion state unless in a microemulsion form.

Additional features and advantages are described herein, and will be apparent from, the following Detailed Description.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"Collector" means a composition of matter that selectively adheres to a particular constituent of the fine and facilitates the adhesion of the particular constituent to the micro-bubbles that result from the sparging of a fine bearing slurry.

"Comminuted" means powdered, pulverized, ground, or otherwise rendered into fine solid particles.

"Concentrate" means the portion of fine which is separated from the slurry by flotation and collected within the froth layer.

"Consisting Essentially of" means that the methods and compositions may include additional steps, components, ingredients or the like, but only if the additional steps, components and/or ingredients do not materially alter the basic and novel characteristics of the claimed methods and compositions.

"Fine" means a composition of matter containing a mixture of a more wanted material, the beneficiary and a less wanted material, the gangue.

"Frother" or "Frothing Agent" means a composition of matter that enhances the formation of the micro-bubbles and/or preserves the formed micro-bubbles bearing the hydrophobic fraction that result from the sparging of slurry.

"Microemulsion" means a dispersion comprising a continuous phase material, substantially uniformly dispersed within which are droplets of a dispersed phase material, the droplets are sized in the range of approximately from 1 to 100 nm, usually 10 to 50 nm.

"Slurry" means a mixture comprising a liquid medium within which fines (which can be liquid and/or finely divided solids) are dispersed or suspended. When slurry is sparged, the tailings remain in the slurry and at least some of the concentrate adheres to the sparge bubbles and rises up out of the slurry into a froth layer above the slurry, the liquid medium may be entirely water, partially water, or may not contain any water at all.

"Stable Emulsion" means an emulsion in which droplets of a material dispersed in a carrier fluid that would otherwise merge to form two or more phase layers are repelled from each other by an energy barrier, the energy barrier may be higher than, as low as 20 kT, or lower, the repulsion may have a half-life of a few years. Enabling descriptions of emulsions and stable emulsions are stated in general in Kirk-Othmer, *Encyclopedia of Chemical Technology*, Fourth Edition, volume 9, and in particular on pages 397-403 and *Emulsions: Theory and Practice,* 3rd Edition, by Paul Becher, Oxford University Press, (2001).

"Surfactant" and "Co-surfactant" is a broad term which includes anionic, nonionic, cationic, and zwitterionic surfactants, a co-surfactant is an additional one or more surfactants present with a first distinct surfactant that acts in addition to the first surfactant, to reduce or further reduce the surface tension of a liquid. Further enabling descriptions of surfactants and co-surfactants are stated in Kirk-Othmer, *Encyclopedia of Chemical Technology*, Third Edition, volume 8, pages 900-912, and in McCutcheon's *Emulsifiers and Detergents*, both of which are incorporated herein by reference.

"Sparging" means the introduction of gas into a liquid for the purpose of creating a plurality of bubbles that migrate up the liquid.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the Kirk-Othmer *Encyclopedia of Chemical Technology,* 5th Edition, (2005), (Published by Wiley, John & Sons, Inc.) this definition shall control how the term is to be defined in the claims.

In at least one embodiment a froth flotation separation process is enhanced by the addition to the slurry of an inventive composition. The composition comprises a frother, a solvent (such as water and/or another solvent) and one or more surfactants (optionally with one or more co-surfactants) and is in the form of a microemulsion. In at least one embodiment the frother is added in an amount that is insufficient to effectively froth the slurry on its own or only at a less than desired rate. However because it is dispersed in the form of a microemulsion the composition froths the slurry much more effectively.

The composition not only enhances the recovery of concentrate but it increases the selectivity of the bubbles increasing the proportion of beneficiary and reducing the proportion of gangue in the concentrate. While effective in many forms of beneficiation the invention is particularly effective in coal flotation.

A microemulsion is a dispersion comprising a continuous phase material, dispersed within which are droplets of a dispersed phase material. The droplets are sized in the range of approximately from 1 to 100 usually 10 to 50 nm. Because of the extremely small size of the droplets, a microemulsion is isotropic and thermodynamically stable. In at least one embodiment the composition comprises materials that if dispersed in droplets larger than microemulsion size, would not be thermodynamically stable and would separate into two or more discrete phase layers. In at least one embodiment the continuous phase material comprises water. In at least one embodiment the dispersed phase material and/or the continuous phase material comprises one or more hydrophobic materials. In at least one embodiment the microemulsion is according to the description within *Terminology of polymers and polymerization processes in dispersed systems* (*IUPAC recommendations* 2001), by Stanislaw Slomkowski et al, Pure and Applied Chemistry Vol. 83 Issue 12, p. 2229-2259 (2011).

In at least one embodiment the microemulsion is stable enough for storage and transport prior to being added to slurry. In at least one embodiment the microemulsion is stable for at least 1 year. In at least one embodiment because the droplets are so small hydrostatic forces that would otherwise coalesce larger droplets into phase layers actually holds the micro-sized droplets in place, thereby making the microemulsion highly stable and highly effective.

Without being limited to a particular theory of the invention and in particular to the construal of the claims, it is believed that by forming a microemulsion, the properties of the frother are fundamentally changed. One effect is that the microemulsion increases the surface area of the dispersed phase frother and thereby increases its effectiveness by increasing the number of particle-bubble interactions. This has the effect of forming more and smaller sparging bubbles than would otherwise form. These more populous and smaller bubbles more effectively adhere to concentrate and more selectively bind beneficiary material.

Although some microemulsions may form spontaneously, when they form, the selection of the components thereof and their relative amounts are very critical for their formation, their final characteristics such as optical appearance, and their organoleptic and thermodynamic time-stability. Unfortunately it is quite difficult to convert a frother composition into a microemulsion. Many frothers are innately hydrophobic and will tend to coalesce and phase separate. In addition, many emulsifying agents will either not form the proper sized droplet or will inhibit the effectiveness of the frother. As a result the following microemulsion frother forming composition are surprisingly effective.

In at least one embodiment the microemulsion composition comprises: 1-99% water, blended with: 1-50% of an alcohol blend which is from the waste stream of the production of 2-ethyl hexanol, 1-20% C8-C10 fatty acids, 1-30% 2-butoxy ethanol surfactant, 1-20% propylene glycol, and 1-10% potassium hydroxide.

In at least one embodiment the microemulsion composition comprises: 1-99% water, blended with: 1-50% of an alcohol blend which is from the waste stream of the production of 2-ethyl hexanol, 1-20% C8-C10 fatty acids, 1-30% 2-butoxy ethanol surfactant, and 1-10% potassium hydroxide.

In at least one embodiment the microemulsion composition comprises: 1-99% water, blended with: 1-50% of an alcohol blend which is from the waste stream of the production of 2-ethyl hexanol, 1-20% C8-C10 fatty acids, 1-30% propylene glycol, and 1-10% potassium hydroxide.

In at least one embodiment the microemulsion composition comprises: 1-99% water, 1-50% of an alcohol blend which is from the waste stream of the production of 2-ethyl hexanol, 1-30% 2-ethyl hexanoic acid, 1-30% 2-butoxy ethanol surfactant, and 1-10% potassium hydroxide.

In at least one embodiment the composition comprises less than 32% water.

When 2-ethyl hexanol is synthesized a waste stream is produced. For example as described in Chinese Patent Publication CN 101973847 B, the waste stream could include but is not limited to, 2-ethylhexan-1-ol, alcohols C12 and higher, dials C8 to C12 and higher, alkyl ethers, alkyl esters, aliphatic hydrocarbons, pyrans $C_{12}H_{24}O$ and $C_{12}H_{22}O$, aliphatic aldehydes and aliphatic acetals. Some or all of the constituents of this waste stream may be used in the inventive composition. A number of commercially available formulations of this alcohol blend are available for sale.

In at least one embodiment the composition added to the slurry contains one or more materials or is added according to one or more of the processes described in one or more of: Canadian Patent Application CA 2150216 A1. United Kingdom Patent Application GB 2171929 A, and *The use of reagents in coal flotation*, by Laskowski, J. S.; et al, Processing of Hydrophobic Minerals and Fine Coal, Proceedings of the UBC-McGill Bi-Annual International Symposium on Fundamentals of Mineral Processing, 1st, Vancouver, B. C., Aug. 20-24, 1995 (1995), pp. 191-197.

In at least one embodiment the dosage range for the microemulsion frother in the slurry would be >0-100 ppm of active frother.

In at least one embodiment the microemulsion is applied to anyone or more of the following processes: beneficiation of ore containing: copper, gold, silver, iron, lead, nickel, cobalt, platinum, zinc, coal, barite, calamine, fledspar, fluorite, heavy metal oxides, talc, potash, phosphate, iron, graphite, kaolin clay, bauxite, pyrite, mica, quartz, and any combination thereof, sulfide ores including but not limited to copper, gold and silver, iron, lead, nickel and cobalt, platinum, zinc, complex sulfide ores such as but not limited to copper-lead-zinc, non-sulfide ores such as coal, barite, calamine, fledspar, fluorite, heavy metal oxides, talc, potash, phosphate, iron, graphite and kaolin clay, and any combination thereof.

In at least one embodiment the microemulsions form spontaneously, when the components are brought together. Provided the components are in the correct proportion, the mixture may be optically clear and/or may be thermodynamically stable. Thus, their manufacturing may be reduced to simple kneading without the need for expensive high energy mixing. Also, often microemulsions are not prone to separation or settling, which may result in their long storage stability. In at least one embodiment only gentle mixing is required to restore a microemulsion if it has been previously frozen.

Representative frothers useful in the invention include but are not limited to aliphatic alcohols, cyclic alcohols, propylene oxide and polypropylene oxide, propylene glycol, polypropylene glycol and polypropylene glycol ethers, polyglycol ethers, polyglycol glycerol ethers, polyoxyparrafins, natural oils such as pine oil an alcohol blend which is from the waste stream of the production of 2-ethyl hexanol and any combination thereof.

Representative surfactants/co-surfactants useful in the invention include but are not limited to polyoxyalkylene homopolymers and copolymers; straight chain or branched mono and polyhydric aliphatic or aromatic alcohols, and their monomeric, oligomeric, or polymeric alkoxylates; C8-C35 Fatty acid salts, unsaturated or saturated, branched or straight chain; di and tri propylene glycol; polypropylene glycol, polypropylene glycol ethers and glycol ethers, and any combination thereof.

In at least one embodiment the microemulsion is an oil-in water type microemulsion.

In at least one embodiment the microemulsion is a water-in oil type microemulsion.

In at least one embodiment the microemulsion is one or more of a: Winsor type I microemulsion, Winsor type II microemulsion, Winsor type III microemulsion, and any combination thereof.

The composition may be used along with or in the absence of a collector. It may be added to the slurry before, after, or simultaneous to the addition of a collector. It may be added before during or after sparging and/or beneficiation has begun. The composition may be used with or in the absence of any collector in any flotation process.

When used along with a collector, the collector may comprise at least one of the collector compositions and/or other compositions described in scientific papers: *Application research on emulsive collector for coal flotation*, by CL. Han et al., Xuanmei Jishu, vol. 3 pages 4-6 (2005). *The use of reagents in coal flotation*, by J. S. Laskowski, Proceedings of the UBC-McGill Bi-Annual International Symposium on Fundamentals of Mineral Processing, Vancouver, BC, CIMM, Aug. 20-24 (1995), *Effect of collector emulsification on coal flotation kinetics and on recovery of different particle sizes*, by A. M. Saleh, Mineral Processing on the verge of the 21st Century, Proceedings of the International Mineral Processing Symposium, 8th Antalya, Turkey, Oct. 16-18, 2000, pp. 391-396 (2000), *Application of novel emulsified flotation reagent in coal slime floatation*, by W. W. Xie, Xuanmei Jishu vol. 2 pp. 13-15 (2007). *A study of surfactant/oil emulsions for fine coal flotation*, by Q. Yu et al., Advance in Fine Particle Processing, Proc. Int. Symp. pp. 345-355, (1990), and *Evaluation of new emulsified floatation reagent for coal*, by S. Q. Zhu, Science Press Beijing, vol. 2 pp. 1943-1950 (2008).

In at least one embodiment at least part of the collector is at least one item selected from the list consisting of: fatty acids, fatty acid esters, neutralized fatty acids, soaps, amine compounds, petroleum-based oily compounds (such as diesel fuels, decant oils, and light cycle oils, kerosene or fuel oils), organic type collector, and any combination thereof.

In at least one embodiment the organic type collector is a sulfur containing material which includes such items as xanthates, xanthogen formates, thionocarbamates, dithiophosphates (including sodium, zinc and other salts of dithiophosphates), and mercaptans (including mercaptobenzothiazole), ethyl octylsulfide, and any combination thereof.

In at least one embodiment the collector includes "extender oil" in which at least one second collector is used to reduce the required dosage of at least one other more expensive collector.

In at least one embodiment the emulsifier comprises at least one of the surfactants described in the scientific textbook *Emulsions: Theory and Practice,* 3rd Edition, by Paul Becher, Oxford University Press, (2001).

In at least one embodiment the surfactant is at least one item selected from the list consisting of: ethoxylated sobitan esters (such as Tween 81 by Sigma Aldrich), soy lecithin, sodium stearoyl lactylate, DATEM (Diacetyl Tartaric Acid) Ester of Monoglyceride), surfactants, detergents, and any combination thereof.

In at least one embodiment the following items are added to a slurry medium: fines, frother, a microemulsion forming surfactant, and optionally a collector. The items can be added simultaneously or in any possible order. Any one, some, or all of the items can be pre-mixed together before being added to the slurry medium. The slurry medium can be any liquid including but not limited to water, alcohol, aromatic liquid, phenol, azeotropes, and any combination thereof. Optionally the items can include one or more other additives.

EXAMPLES

The foregoing may be better understood by reference to the following examples, which are presented for purposes of illustration and are not intended to limit the scope of the invention. In particular the examples demonstrate representative examples of principles innate to the invention and these principles are not strictly limited to the specific condition recited in these examples. As a result it should be understood that the invention encompasses various changes and modifications to the examples described herein and such changes and modifications can be made without departing from the spirit and scope of the invention and without diminishing its intended advantages. It is therefore intended that such changes and modifications be covered by the appended claims.

Two frother microemulsion samples were prepared and tested. They were applied to a coal ore beneficiation process in various amounts and in both the presence and the absence of a collector. Their effectiveness is presented on Table 1. Yield % is a measurement of how much of the fines were removed as concentrate. Ash % is a measure of how much unwanted material was present in the concentrate when the coal was burned. The performance of the microemulsion samples were compared to the effectives of a commercially available MIBC frother and another commercially available frother (Component A).

Sample 1 contained 30%, frother component A being a commercially available alcohol blend, a waste stream derived from the production of 2-ethyl hexanol, 5%, commercially available fatty acid, 15%, commercially available surfactant 2-butoxy ethanol, 15%, commercially available polypropylene glycol, 31.5% water, and 3.5% potassium hydroxide (45%) solution in water.

Sample II contained 50%, frother component A being a commercially available alcohol blend, a waste stream derived from the production of 2-ethyl hexanol, 15% commercially available fatty acid, 2-ethyl hexanoic acid, 14.0%, commercially available surfactant 2-butoxy ethanol, 15.5% water, and 5.5% potassium hydroxide (45%) solution in water.

Samples 1 and 2 are examples which representative the general principle of converting any frothing agent into the form of a microemulsion and using that its microemulsion as the frothing agent.

TABLE I

| Collector | Dosage (g/T) | Frother Used | Frother Dosage (ppm) | Active Frother Component Dosed (ppm) | Yield % | Ash % | Recovery % |
|---|---|---|---|---|---|---|---|
| — | 0 | MIBC | 3.0 | 3.0 | 22.10 | 5.09 | 32.28 |
| — | 0 | MIBC | 5.0 | 5.0 | 32.73 | 6.44 | 47.56 |
| — | 0 | MIBC | 8.0 | 8.0 | 43.36 | 7.22 | 64.44 |
| — | 0 | Component A | 3.0 | 3.0 | 22.15 | 5.90 | 32.97 |
| — | 0 | Component A | 5.0 | 5.0 | 28.51 | 6.19 | 41.74 |
| — | 0 | Component A | 8.0 | 8.0 | 34.67 | 6.31 | 51.39 |
| — | 0 | Sample 1 | 3.0 | 0.9 | 15.51 | 5.91 | 23.12 |
| — | 0 | Sample 1 | 5.0 | 1.5 | 29.78 | 6.47 | 44.79 |
| — | 0 | Sample 1 | 8.0 | 2.4 | 39.00 | 6.76 | 55.62 |
| — | 0 | Sample 2 | 3.0 | 1.5 | 36.61 | 6.32 | 54.77 |
| — | 0 | Sample 2 | 5.0 | 2.5 | 39.00 | 6.56 | 56.83 |
| — | 0 | Sample 2 | 8.0 | 4.0 | 42.69 | 6.79 | 62.48 |
| Diesel | 170 | Component A | 6.0 | 6.0 | 52.10 | 6.67 | 76.13 |
| Diesel | 170 | Sample 1 | 6.0 | 1.8 | 52.25 | 7.16 | 76.90 |
| Diesel | 170 | Sample 2 | 6.0 | 3.0 | 52.94 | 7.33 | 77.14 |

The data demonstrates that a much smaller amount of active frother composition (as low as 20-60% or more, or even less) is required to get the same or better effects than a may larger amount of frother if the frother is added to the slurry in the form of a microemulsion.

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of enhancing the performance of a frother in a froth flotation separation of slurry in a medium, the method comprising the steps of:

blending a stable frother microemulsion, the medium, fines, and optionally other additives, and removing concentrate from the slurry by sparging the slurry;

wherein the microemulsion comprises a continuous phase which is a carrier fluid and a dispersed phase, the microemulsion as a whole by weight is made up of: 1-99% water, 1-50% of an alcohol blend which is from the waste stream of the production of 2-ethyl hexanol, 1-15% C8-C10 fatty acids, 1-30% 2-butoxy ethanol, 1-20% propylene glycol, and 1-10% potassium hydroxide.

2. The method of claim 1 in which the microemulsion improves the efficiency of froth separation process.

3. The method of claim 2 in which more concentrate is removed than if a greater amount of frother had been used in a non-microemulsion form.

4. The method of claim 1 in which the continuous phase is water.

5. The method of claim 1 in which the microemulsion further comprises a surfactant selected from the group consisting of: polyoxyalkylene homopolymers, polyoxyalkylene copolymers, straight chain polyhydric polymers, branched polyhydric polymers, C8-C35 Fatty acid salts, propylene glycol, polypropylene glycol, polypropylene glycol ethers, glycol ethers, ethoxylated sorbitan esters, soy lecithin, sodium stearoyl lactylate, Diacetyl Tartaric Acid Ester of Monoglyceride), detergents, and any combination thereof.

6. The method of claim 1 in which the carrier fluid comprises one item selected from the group consisting of: water, alcohol, aromatic liquid, phenol, azeotropes, and any combination thereof.

7. The method of claim 1 in which the microemulsion further comprises a surfactant.

8. The method of claim 1 in which the slurry comprises an ore containing one item selected from the list consisting of: copper, gold, silver, iron, lead, nickel, cobalt, platinum, zinc, coal, barite, calamine, feldspar, fluorite, heavy metal oxides, talc, potash, phosphate, iron, graphite, kaolin clay, bauxite, pyrite, mica, quartz, sulfide ore, complex sulfide ore, non-sulfide ore, and any combination thereof.

9. The method of claim 1 in which the frother would not remain in a stable emulsion state unless in a microemulsion form.

10. The method of claim 1 in which the microemulsion comprises a surfactant along with at least one co-surfactant.

11. The method of claim 1 in which the frother comprises only one or a combination of more than one active frother components.

12. The method of claim 1 in which the microemulsion further comprises one item selected from the group consisting of: 2-ethylhexan-1-ol, alcohols with no less than 12 carbon atoms, diols with no less than 8 carbon atoms, alkyl ethers, alkyl esters, aliphatic hydrocarbons, $C_{12}H_{24}O$ pyran, $C_{12}H_{22}O$ pyran, aliphatic aldehydes, aliphatic acetals, and any combination thereof.

13. A method of enhancing the performance of a frother in a froth flotation separation of slurry in a medium, the method comprising the steps of:

blending a stable frother microemulsion, the medium, fines, and optionally other additives, and removing concentrate from the slurry by sparging the slurry;

wherein the microemulsion comprises a continuous phase which is a carrier fluid and a dispersed phase, the microemulsion as a whole by weight is made up of: 1-99% water, 1-50% of an alcohol blend which is from the waste stream of the production of 2-ethyl hexanol, 1-20% C8-C10 fatty acids, 1-30% 2-butoxy ethanol, and 1-10% potassium hydroxide.

14. A method of enhancing the performance of a frother in a froth flotation separation of slurry in a medium, the method comprising the steps of:

blending a stable frother microemulsion, the medium, fines, and optionally other additives, and removing concentrate from the slurry by sparging the slurry;

wherein the microemulsion comprises a continuous phase which is a carrier fluid and a dispersed phase, the microemulsion as a whole by weight is made up of: 1-99% water, 1-50% of an alcohol blend which is from the waste stream of the production of 2-ethyl hexanol, 1-20% C8-C10 fatty acids, 1-30% propylene glycol, and 1-10% potassium hydroxide.

15. A method of enhancing the performance of a frother in a froth flotation separation of slurry in a medium, the method comprising the steps of:

blending a stable frother microemulsion, the medium, fines, and optionally other additives, and removing concentrate from the slurry by sparging the slurry;

wherein the microemulsion comprises a continuous phase which is a carrier fluid and a dispersed phase, the microemulsion as a whole by weight is made up of: 1-99% water, 1-50% of an alcohol blend which is from the waste stream of the production of 2-ethyl hexanol, 1-30% 2-ethyl hexanoic acid, 1-20% 2-butoxy ethanol, and 1-10% potassium hydroxide.

* * * * *